US009227220B1

(12) United States Patent
Salmon

(10) Patent No.: US 9,227,220 B1
(45) Date of Patent: Jan. 5, 2016

(54) METHOD FOR PATTERNING MATERIALS ON A SUBSTRATE

(71) Applicant: Peter C. Salmon, Mountain View, CA (US)

(72) Inventor: Peter C. Salmon, Mountain View, CA (US)

(73) Assignee: I-BLADES, INC., Danville, CA (US)

( * ) Notice: Subject to any disclaimer, the term of this patent is extended or adjusted under 35 U.S.C. 154(b) by 394 days.

(21) Appl. No.: 13/684,266

(22) Filed: Nov. 23, 2012

Related U.S. Application Data

(60) Provisional application No. 61/563,504, filed on Nov. 23, 2011.

(51) Int. Cl.
*B05D 1/36* (2006.01)
*B05D 3/14* (2006.01)

(52) U.S. Cl.
CPC ..... *B05D 3/145* (2013.01)

(58) Field of Classification Search
CPC ..... B05D 3/145
See application file for complete search history.

(56) References Cited

U.S. PATENT DOCUMENTS 8,654,502 B2 * 2/2014 Maijala et al. ..... C23C 24/10 156/277

* cited by examiner

*Primary Examiner* — Xiao Zhao
(74) *Attorney, Agent, or Firm* — Kilpatrick Townsend & Stockton LLP

(57) ABSTRACT

A patterning method involves providing a flexible web comprising embedded electrical charges, deposition material having polar properties, a substrate, and a transfer electrode, wherein the flexible web is passed through the deposition material and accumulates material in accordance with the embedded electrical charges, and the accumulated material is transferred to the substrate at the transfer electrode. A production line may be configured in a reel-to-reel implementation. Each station may include finishing operations on the deposited material, including but not limited to heating, annealing, curing, fusing, surface-treating, laser-processing, charge neutralizing, barrier processing, etching, electroplating, and passivating.

17 Claims, 4 Drawing Sheets

METHOD FOR PATTERNING MATERIALS ON A SUBSTRATE

CROSS-REFERENCES TO RELATED APPLICATIONS

This application claims priority to U.S. Provisional Patent Application No. 61/563,504, filed on Nov. 23, 2011, entitled "Method for Patterning Materials on a Substrate," the disclosure of which is hereby incorporated by reference in its entirety for all purposes. Co-pending U.S. patent application Ser. No. 13/477,965, "Method for Controlling the Coupling and Friction between Opposing Surfaces" filed May 22, 2012 is hereby incorporated by reference in its entirety for all purposes.

TECHNICAL FIELD

This invention relates to methods for patterning materials on a substrate and more particularly to methods using embedded electrical charges for patterning materials on a substrate.

BACKGROUND OF THE INVENTION

Many methods have been developed for patterning materials on substrates. One method employs a photoresist and a shadow mask, wherein light passes through the shadow mask and selectively exposes the photoresist. The exposed photoresist is then developed and cured to create a patterned photoresist. An etchant that is subsequently applied to the substrate will etch only regions where the photoresist is absent. Alternatively, materials can be deposited on the photoresist and patterned by a lift process, wherein the photoresist swells on application of a solvent, thereby removing the deposited film where the photoresist is present. Additionally, some semiconductor processing materials have been developed with photo-active properties, providing a dielectric material that can be patterned like photoresist; an example is benzocyclo butene (BCB).

In some cases a thin seed layer is patterned, then this layer is plated up to create a thicker layer. This process is well known using copper as the deposition material, for example in the fabrication of printed wiring boards (PWBs).

Methods for etching deposited films include wet etching in a bath of etchant, dry etching using a plasma process in a vacuum, or sputter etching.

Many efforts have been applied to the concept of low cost fabrication of patterned substrates using reel-to-reel processing. Using this method, desired film materials may be deposited on a moving flexible substrate. Some processes such as ink jet printing may be conducted at atmospheric pressure. However, higher quality films may be produced under vacuum. For fabrication of films requiring vacuum processing, a source reel on which the flexible substrate is wound may be moved into a vacuum system for processing, and a take-up reel containing the processed film may be removed when processing is complete. Inside the vacuum chamber the flexible substrate may move serially through multiple processing stations. However, such vacuum systems tend to be expensive, and the parts produced have had a higher fabrication cost than desired.

Accordingly it is desirable to provide a system for fabricating patterned materials on substrates that can be a reel-to-reel system that is operable to produce high quality films without any vacuum required. Such a system may be amenable to automation and may have the potential for low fabrication cost.

SUMMARY OF THE INVENTION

The present invention relates generally to fabrication methods for electronic devices. More specifically, methods and systems for depositing a patterned material on a substrate are described herein. Certain embodiments of the present invention enable patterning of materials on substrates at standard room pressure, i.e., not requiring a vacuum. Merely by way of example, the invention can be applied to electronic devices having screens or other display elements for displaying images.

According to an embodiment, a method of patterning a material on a substrate is provided. The method includes providing a patterning web that is flexible and has patterns of electrical charge embedded therein. Exemplary techniques for embedding electrical charges are described in co-pending U.S. patent application Ser. No. 13/477,965, referenced above and the contents of which is incorporated herein. The patterning web is passed through a bath containing a deposition material having polar properties, thereby accumulating patterned material in accordance with the electrically charged patterns. Subsequently the patterned material is transferred to a substrate at a transfer electrode. Thus a desired material is patterned on a substrate, achieved in a non-vacuum system using a reel-to-reel fabrication process at ordinary room pressure.

According to another embodiment of the present invention, a device is provided. The device comprises a flexible patterning web, a pattern of electrical charges embedded in the patterning web, a substrate, corresponding alignment marks on the patterning web and on the substrate, a bath of deposition material having polar properties, and a transfer electrode. The patterning web is passed through the bath causing the deposition material to accumulate in accordance with the embedded electrical charges, and the accumulated material is transferred to the substrate at the transfer electrode.

Numerous benefits can be achieved by way of certain embodiments of the present invention over conventional techniques. For example, low cost fabrication of patterned substrates can be achieved using a reel-to-reel process at ordinary room pressure. Utilizing certain embodiments of the present invention, multiple patterned layers can be deposited in sequence, to provide a complete electronic display for example, in an automated reel-to-reel (or "roll-to-roll") fabrication process. In one embodiment, the electronic display is an active matrix organic light emitting diode (AMOLED) display, including a backplane comprising thin film transistors (TFTs), organic colorants, and a barrier layer to protect the structure from the effects of water. Although a display circuit is described, in principle any form of electronic circuit can be fabricated using the proposed method, providing the deposition materials or inks can be provided in the necessary polar form. Indeed the circuit produced need not be an electronic circuit; it could be a painting or an expression of art for example; it may have relief features to create a three-dimensional product. It could be a three-dimensional component comprised of multiple printed layers. The layers may comprise one material or multiple materials; for example the layers may be consecutively applied to create a unified physical prototype. Additionally, in alternative embodiments the substrate may be thin or thick, rigid or flexible, opaque or clear.

These and other embodiments of the invention along with many of its advantages and features are described in more detail in conjunction with the text below and attached figures.

DETAILED DESCRIPTION OF SPECIFIC EMBODIMENTS

An embodiment of the present invention relates to a production line involving reel-to-reel patterning of materials on a substrate without requiring a vacuum. The materials may comprise multiple patterned layers, implemented using a single pass or multiple passes of the substrate through the production line.

A further embodiment of the present invention relates to a method for patterning materials on a substrate. A patterning web is provided which has patterns of embedded electrical charge. The patterns of electrical charge form a latent charge image of the patterned layer to be produced on the substrate. The patterning web is passed through a bath containing a deposition material having polar properties; the polar properties may comprise ionic configurations, or polar molecules, or any fine (microscopic or nanoscopic) structure having a dipole moment. By passing through the bath, patterned material is accumulated on the patterning web, in accordance with the embedded charge patterns (latent charge image). Subsequently the accumulated material is transferred to the substrate at a transfer station. The transfer station may comprise a charged surface, or a conductive surface at a high electric potential. The flexible substrate may comprise a polymer such as polyimide, or a metal such as stainless steel, or any other suitable materials.

Each processing station may be additionally configured to provide finishing operations on the deposited material. Finishing operations may include physical operations, operations involving radiation, chemical, or coating operations. Examples of physical operations include fusing, compressing, sintering or smoothing. Examples of radiation include laser, infrared, ultra-violet, electron and ion irradiation as examples. Examples of chemical operations include wet and plasma etching, electro-plating, and atomic layer deposition. Examples of coatings include sealants, passivations, and barrier layers.

Figure 1:
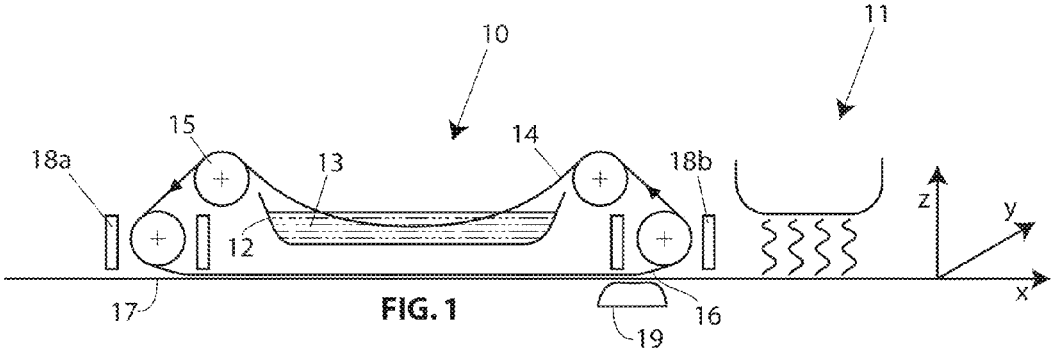
FIG. 1. is a schematic side view of an exemplary substrate patterning system of the present invention.

FIG. 1 depicts a side view of a non-vacuum station 10 and a finishing station 11 of the present invention. Station 10 includes a bath 12 containing a deposition material 13 having a fluid form and polar properties. The polar properties may be carried by a polar entity; the entity may be a particle, a molecule, a fluid droplet containing nano-particles, or any element having a dipole moment. A flexible patterning web 14 passes over rollers 15, forming a loop as shown. Web 14 conveys a latent charge image corresponding to the patterned material to be deposited on the substrate 17. The charge image consists of multiple electrically charged regions, either positively or negatively charged. The loop is loosely draped 16, enabling an alignment method involving electrically charged alignment features on patterning web 14 and corresponding electrically charged alignment features on substrate 17, to be further described in reference to FIG. 2 and FIG. 3. On passing through the bath of deposition material 13, web 14 accumulates material in accordance with the latent charge image, in this example due to Coulomb forces asserted on the charge elements of deposition material 13. Alignment sensors 18*a*, 18*b* may be configured to sense optical alignment of corresponding visual alignment marks on web 14 and on substrate 17. Additionally they may be configured to sense electric potential for aligning electrical charge features on web 14 with corresponding electrical charge features on substrate 17, and both types of alignment sensors may be used. A transfer electrode 19 is shown, for transferring accumulated material on web 14 to the substrate 17. Transfer electrode 19 may comprise a high density of charge, or a high electric potential. A corotron may be used to create the high density of charge. Transfer electrode 19 may extend beyond the point of separation of patterning web 14 as shown.

Deposition material 13 may also be a dry powder. The dry powder may initially be charged or uncharged. A charged powder may be patterned using, for example, Coulomb forces created by embedded charges in patterning web 14. An uncharged powder may be patterned using, for example, electric field gradients that exist at the surface of patterning web 14, by virtue of the embedded charges.

For good dimensional stability and good alignment capabilities the base substrates of web 14 and substrate 17 may comprise the same or a similar material composition. In the embodiment described in FIGS. 1 and 2, the substrate material may be a polyimide that is either clear or only partially opaque. The polyimide base material may provide a tough and dimensionally stable yet flexible support, withstanding processing temperatures up to around 350° C. The preferred thickness of both substrates is around 100 μm. Other substrate materials and thicknesses may be used.

Figure 2:
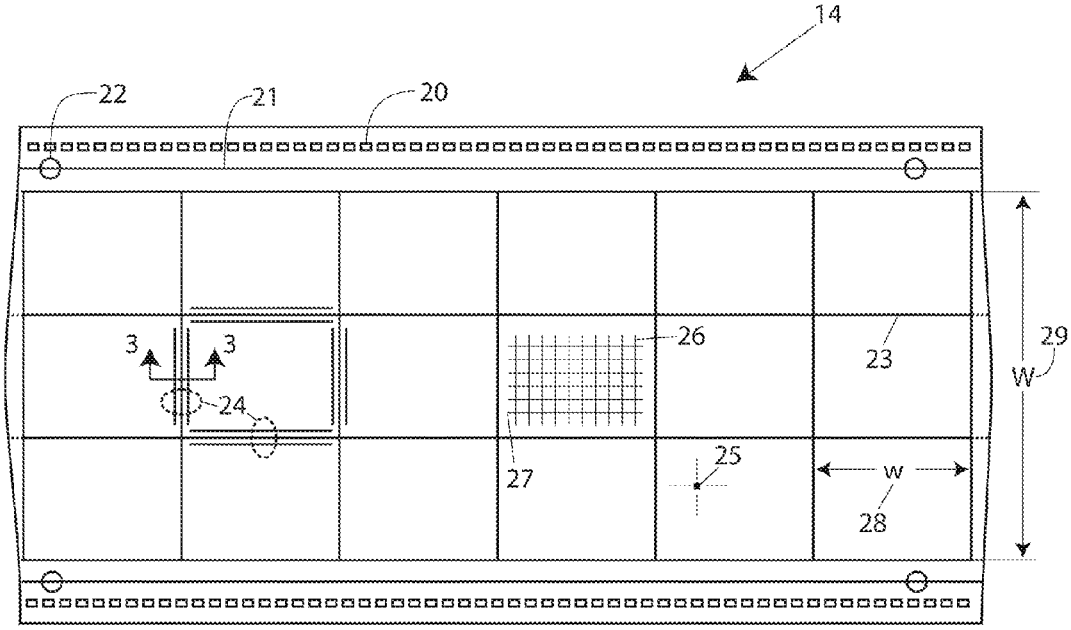
FIG. 2 is an expanded top view of a portion of a continuous feed web of an exemplary embodiment of the present invention; the web carries a latent charge image.

FIG. 2 shows a top view of an exemplary patterning web 14 of certain embodiments of the present invention. A latent charge image is provided on web 14, in accordance with the patterned layer to be produced on substrate 17. Sprocket holes 20, alignment marks 21, and aperture 22 of an alignment sensor are shown. Other mechanical drive components may be employed, such as precision-ground rubber rollers driven by brushless servo motors. Sprocket holes 20 are used to move web 14 like a conveyor belt, and a similar arrangement (not shown) is used to move substrate 17 like a conveyor belt. Mechanical configurations (not shown) may be provided for coarsely aligning the two conveyor belts. Alignment mark 21 may be a visual line, used in conjunction with alignment features that comprise lines of electric charge. The outline of an individual circuit 23 is shown. In a preferred embodiment the individual circuit to be produced on substrate 17 is an active matrix organic light emitting diode (AMOLED) display, comprising a backplane of TFTs for row and column addressing of pixels 25 in the display. The pixels are arrayed in the x and y directions to form a complete display screen, and they may include organic colorants that are individually excited by transistors in the TFT backplane. In existing AMOLED displays, the organic colorants are typically applied in a vacuum chamber by evaporation through a shadow mask. In the display of certain embodiments described herein, the layers of the TFTs and the colorants may be applied using non-vacuum stations 10 and finishing stations 11. Striped charge features 24 are also shown, to be further described in reference to FIG. 3. Vertical lines 26 and horizontal lines 27 are lines of alignment charges that may be provided parallel to column and row lines of the backplane respectively; these may be used to accurately align web 14 with substrate 17 during the cooperative conveyor action that immediately precedes transfer of the accumulated material to substrate 17. To reduce interference with functional circuits, lines 26 and 27 may comprise non-conducting materials. Coarse alignment of the patterning web and the substrate may be achieved using mechanical adjustments. Using a loosely draped web 16 in FIG. 1, fine alignment adjustments may be achieved using the corresponding charged alignment patterns. The fine adjustments may occur locally, whenever misalignment begins to occur. The opposing substrates are brought into accurate registration using the local restoring forces generated by the opposing charge features. A width dimension w 28 of an individual circuit is shown; for an embodiment comprising an AMOLED display this dimension may be around 18-40 cm. The width of the web that is patterned with a charge image, W 29, may be around 0.5-2 meters for example.

Figure 3:
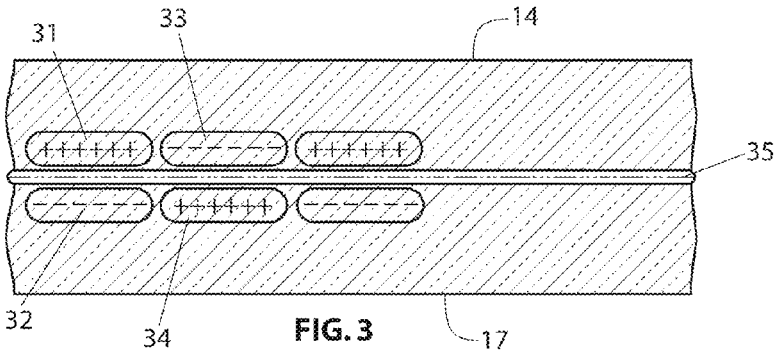
FIG. 3 is a schematic cross-sectional view of section 3-3 of FIG. 2 showing embedded charge features in the patterning web, with corresponding charged regions in the substrate also shown.

FIG. 3 is a schematic cross-sectional view of section 3-3 of web 14 shown in FIG. 2, and includes a portion of underlying substrate 17 so that corresponding charge features can be visualized. A positively charged feature 31 in web 14 is shown opposing a negatively charged feature 32 in substrate 17. The attraction of these two charge elements, as well as repulsion from adjacent elements 33 and 34, causes a restoring force that pulls web 14 and substrate 17 into accurate alignment. To reduce friction between web 14 and substrate 17 a lubricating film 35 may be provided, allowing fine alignment corrections. For an oily film 35 having a thickness less than 1 μm, an alignment accuracy of 2-3 μm may be achieved over short distances such as w 28 of FIG. 2, and potentially over much larger distances if charged features like 26 and 27 in FIG. 2 are utilized.

Achieving accurate alignment can be critical to achieving high quality in various contexts and achieving the precise alignment can be achieved in various ways and by modifying the exemplary techniques disclosed herein as will be apparent to those of skill in the art. In the above-described exemplary methods for achieving alignment, the cooperation aspect of the conveyor action can include behavior wherein local regions of web 14 and substrate 17 respond to restoring forces generated by charged alignment features such as 31-34, causing the opposing surfaces to continuously move into more precise alignment during the period in which they are in close proximity, culminating in the most precise alignment at the critical location where transfer occurs.

Figure 4:
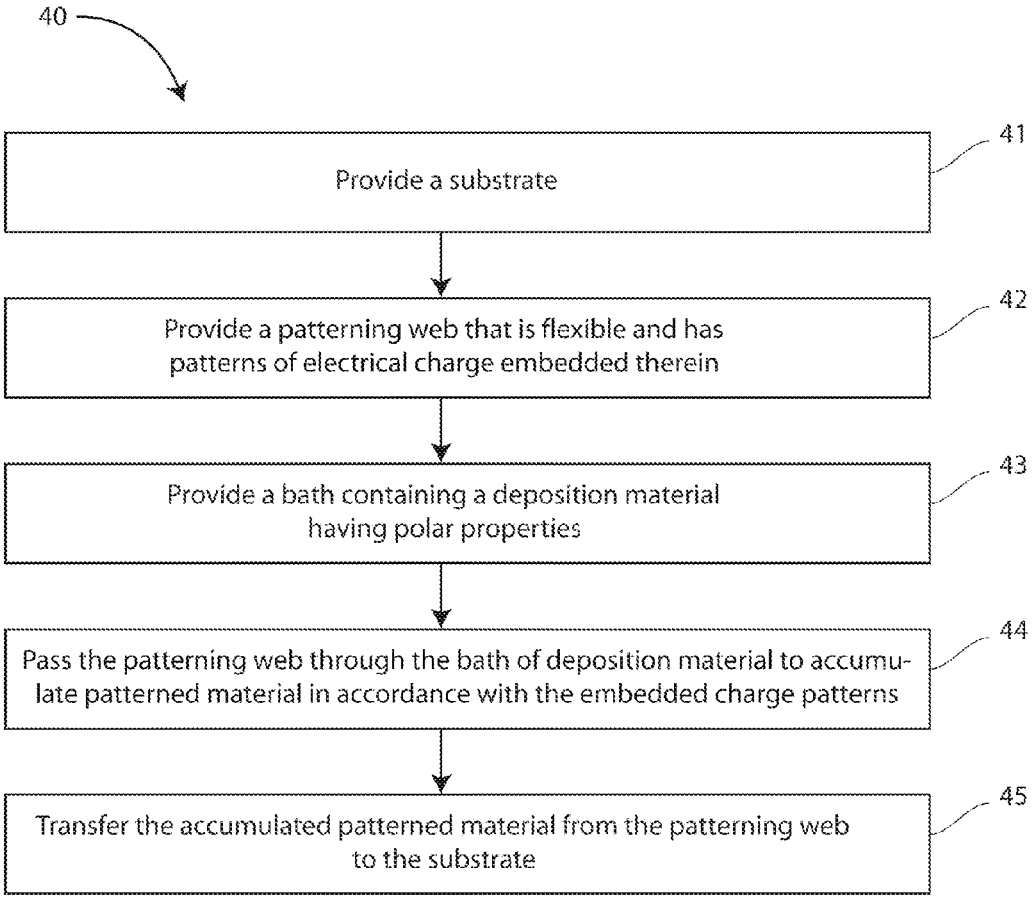
FIG. 4 is a flow chart depicting an exemplary method for depositing patterned material on a substrate.

FIG. 4 is a flow chart depicting an exemplary method 40 for depositing patterned material on a substrate. Method 40 includes processing steps as follows: providing a substrate, step 41; providing a patterning web that is flexible and has patterns of electrical charge embedded therein, step 42; providing a bath containing a deposition material having polar properties, step 43; passing the patterning web through the deposition material and accumulating patterned material in accordance with the embedded charge patterns, step 44; and transferring the accumulated patterned material from the patterning web to the substrate, step 45. In alternative embodiments, this exemplary flow chart may be expanded to include a variety of finishing processes or operations on the material transferred to the substrate. These may include any of the following, individually or in combination: heating, fusing, annealing, curing, surface-treating, laser processing, drying, charge embedding, charge neutralizing, barrier processing, etching, electroplating, and passivating. Other finishing processes or operations may be used.

Figure 5:
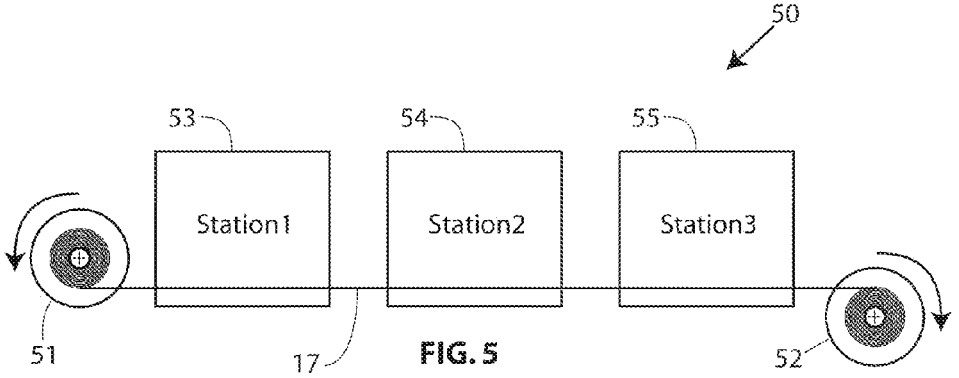
FIG. 5 is a block diagram of an exemplary production line.

FIG. 5 is a block diagram of an exemplary production line 50. Production line 50 includes a reel-to-reel configuration as shown, wherein substrate 17 is fed from source reel 51 and taken up on destination reel 52. In the figure, substrate 17 passes through processing stations 53, 54, and 55 in sequence, each processing station providing an additional patterned layer of material on substrate 17, as further described in reference to FIGS. 6-17. In preferred embodiments, stations 53, 54, and 55 are all non-vacuum stations as previously described. Stations 53-55 may also be adapted or configured to support a wide range of finishing options, previously described. Deposited materials may comprise polymers, dielectrics, organic or inorganic materials, binders, conductors, or composites as examples. Composites may further comprise nano-materials such as carbon nanotubes (CNTs) or graphene or silver nanowires for example; they may be infused into a polymer or matrix of materials. For more complex layered circuits or constructions, ten or more processing stations may be used.

Figure 6:
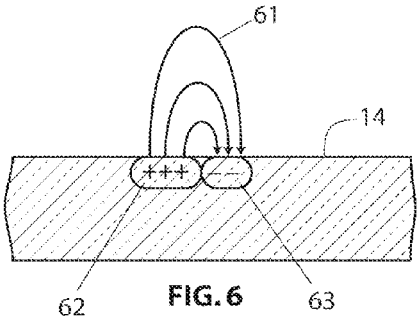
FIG. 6 depicts an electric field associated with embedded charges in a flexible web material.

FIG. 6 depicts electric field lines 61 emanating from the surface of a flexible substrate 14, resulting from an embedded positive charge 62 adjacent an embedded negative charge 63.

Figure 7:
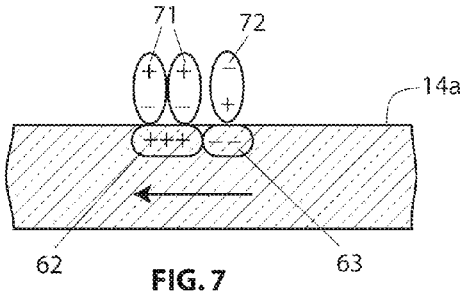
FIG. 7 shows polar entities attracted to the embedded charges of FIG. 6.

FIG. 7 shows patterning web 14*a* which has moved through a bath of deposition material such as depicted in FIG. 1. Web 14*a* has accumulated polar entities 71 and 72 as shown, and they adhere to the surface of substrate 14*a* in this example due to Coulomb forces. Polar entities 71 and 72 have different orientations because of the different polarities of charge opposing them. Web 14*a* is moving from right to left.

Figure 8:
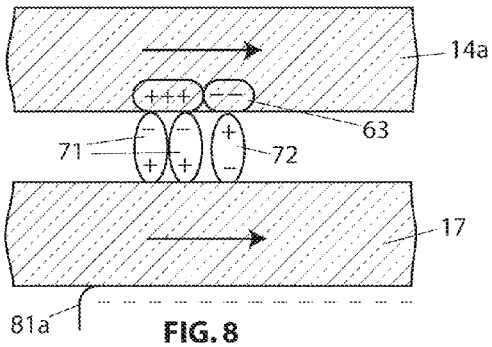
FIG. 8 shows the polar entities of FIG. 7 carried adjacent a mechanically synchronized substrate at a transfer station.

FIG. 8 illustrates synchronized motion between patterning web 14*a* and flexible substrate 17 as they move from left to right underneath the bath 12 of FIG. 1. The effect of transfer electrode 81*a* is to attract suitably oriented polar entities 71. Despite repulsion from transfer electrode 81*a*, polar entity 72 may also be present owing to strong attraction to embedded charge 63.

Figure 9:
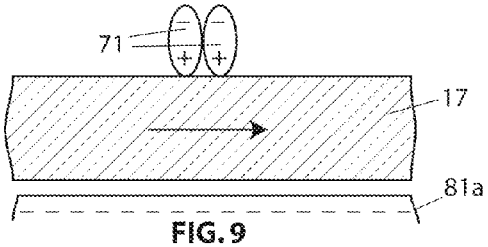
FIG. 9 shows that after the patterning web has peeled away the polar entities of FIG. 8 have been selectively transferred to the substrate.

FIG. 9 illustrates selective attraction of polar entities 71 to substrate 17 in the presence of transfer electrode 81*a*, after patterning web 14*a* has peeled away from substrate 17.

Figure 10:
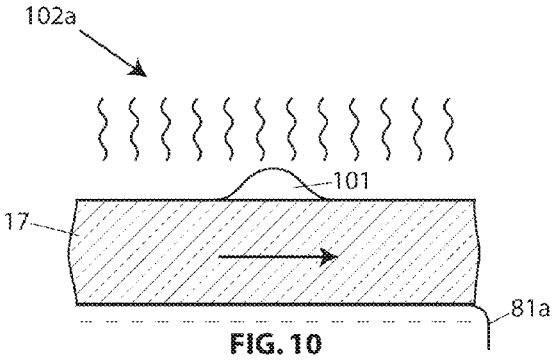
FIG. 10 illustrates a process of fusing the transferred polar entities of FIG. 9 onto the substrate.

FIG. 10 depicts fusing of polar entities 71 of FIG. 9 into a flattened deposit 101 under the influence of a fusing radiation 102*a*. Fusing radiation 102*a* may also act to neutralize charge remaining in deposit 101. A separate discharging procedure may also be used such as a diminishing amplitude of AC voltage, and this may be applied after substrate 17 has moved away from the influence of transfer electrode 81*a*. Alternatively, deposit 101 may desirably be left in a charged state, to influence the pattering of a subsequent layer of deposition material.

Figure 11:
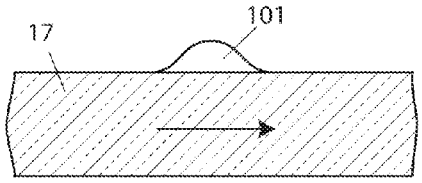
FIG. 11 shows the fused deposit on the substrate as it exits the first finishing station.

FIG. 11 shows a completed first deposit on substrate 17, as substrate 17 moves to a second processing station.

Figure 12:
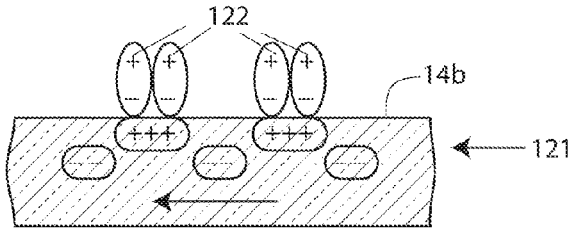
FIG. 12 depicts a flexible web of a second station, the web comprising a second set of embedded charges, with a second set of polar entities held by Coulomb attraction.

FIG. 12 illustrates a pattern of embedded charges 121 in patterning web 14*b* of a second processing station, as web 14*b* moves through a bath similar to bath 12 of FIG. 1. Embedded charges 121 are configured in a manner that will attract only polar entities 122 of a single orientation as shown. Embedded charge pattern 121 comprising embedded charges of different polarities at different depths is an alternative to the pattern represented by embedded charges 62 and 63 of FIG. 6, wherein both polarities of embedded charges are provided at a single depth.

Figure 13:
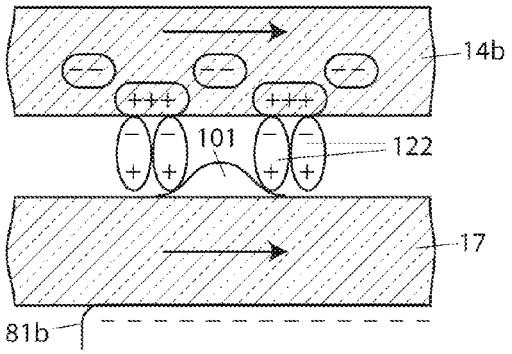
FIG. 13 shows the second set of polar entities of FIG. 12 carried adjacent the mechanically synchronized substrate at a second transfer station.

FIG. 13 shows patterning web 14*b* moving in synchronism with substrate 17 carrying first deposit 101. Polar entities 122 have their positive ends attracted to transfer electrode 81*b*.

Figure 14:
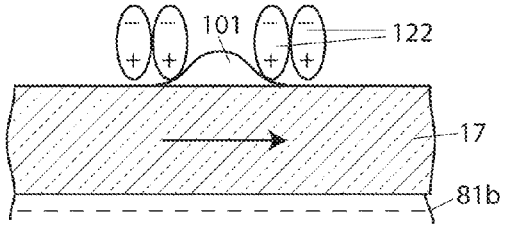
FIG. 14 shows the transferred second set of polar entities on a substrate, after the patterning web has peeled away.

FIG. 14 illustrates substrate 17 moving with first deposit 101 and polar entities 122, after separation from patterning web 14*b*.

Figure 15:
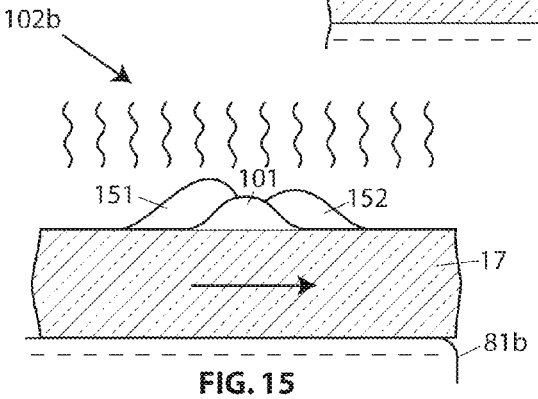
FIG. 15 illustrates the process of fusing the second set of polar entities onto the substrate.

FIG. 15 illustrates the fusing of polar entities 122 of FIG. 14 into second deposits 151 and 152 on substrate 17, while under the influence of transfer electrode 81*b*. Radiative heating 102*b* is shown which may comprise infrared radiation. In place of heating radiation 102*b* a heated fusing roller may also be employed for example, and this may have the effect of further flattening deposits such as 101, 151, and 152.

Figure 16:
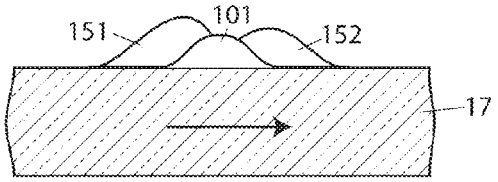
FIG. 16 depicts first and second deposits on the substrate as the substrate exits the second finishing station.

FIG. 16 shows completed first deposit 101 and completed second deposits 151 and 152, as substrate 17 moves toward a third processing station for example.

Figure 17:
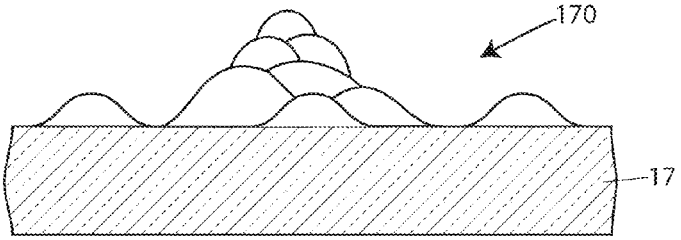
FIG. 17 illustrates an example of multiple layers of fused materials that have been patterned on the substrate.

FIG. 17 illustrates a more complex patterning of layers 170, corresponding to more processing stations employed. For complex circuits, 10 or more processing stations may be used for example.

Numerous benefits are achieved by way of the present invention over conventional techniques. For example, it is well known that the cost of fabricating layered circuits on a substrate can be dramatically reduced using reel-to-reel processing. Turn-around time for electronic circuits and other constructions can also be substantially reduced using this type of configuration. The degree of process automation can potentially be increased because of a unified flow of materiel among other factors. For the case of AMOLED displays, it has been difficult to create large displays because of precision requirements on the shadow mask required for patterning the organic colorants. Embodiments of the present invention enable a coarse alignment of layers using mechanical adjustments, plus a fine alignment enabled by charged features. The fine alignment can operate over short distances corresponding to individual circuits. In addition, providing charged vertical and/or horizontal alignment lines across the face of a large circuit may enable accurate alignment over large distances, wherein the two opposing substrates in contact cooperatively adjust to any incipient misalignment; this particularly applies when the two substrates are implemented as films having a thickness of 100 μm or less. Circular lines of charge may also be used, or lines that are positioned where alignment is critical. Thus embodiments of the present invention, together with the development of polar inks, may enable 60-inch or larger display screens using AMOLED technology, to match the current large size capability of liquid crystal displays (LCDs) for example.

In certain contexts it may be desirable to use the proposed patterning method inside a vacuum chamber. For example, a vacuum chamber may be used if certain deposits are reactive with air.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A method of patterning a substrate, the method comprising:

passing a patterning web through a deposition material having polar properties, the patterning web comprising an electrically-charged pattern embedded therein; and transferring material to the substrate at a transfer electrode, wherein the material accumulates in accordance with the electrically-charged pattern.

2. The method of claim 1 wherein the patterning is performed at standard room pressure.

3. The method of claim 1 wherein the patterning web comprises embedded charges at multiple depths.

4. The method of claim 1 further comprising fusing or curing the material transferred to the substrate.

5. The method of claim 1 further comprising neutralizing electrical charge in the material transferred to the substrate.

6. The method of claim 1 further comprising providing a surface treatment to the material transferred to the substrate.

7. The method of claim 1 further comprising laser processing the material transferred to the substrate.

8. The method of claim 1 further comprising the step of providing corresponding alignment marks on the substrate and on the patterning web.

9. The method of claim 8 wherein the corresponding alignment marks comprise electrical charges.

10. The method of claim 1 wherein the patterning web moves continuously through deposition material such that the deposition material is continuously accumulated.

11. The method of claim 10 wherein the accumulated patterned material is continuously transferred to the substrate.

12. The method of claim 1 wherein a plurality of independent charge patterns are provided on the patterning web, and a corresponding plurality of independent circuits are patterned on the substrate.

13. The method of claim 1 wherein the deposition material having polar properties comprises ions.

14. The method of claim 1 wherein the deposition material having polar properties comprises polar molecules.

15. The method of claim 1 wherein the deposition material having polar properties comprises nano-particulates.

16. The method of claim 1 wherein the substrate is fed past the transfer electrode using a plurality of rollers.

17. The method of claim 1 further comprising electroplating the transferred deposition material.

* * * * *